US007562773B2

(12) United States Patent
Cotsalas

(10) Patent No.: US 7,562,773 B2
(45) Date of Patent: Jul. 21, 2009

(54) POP-UP RUBBER BAND DISPENSER

(76) Inventor: Stephen Cotsalas, 17 Commodore Cir., Port Jefferson, NY (US) 11776

( * ) Notice: Subject to any disclaimer, the term of this patent is extended or adjusted under 35 U.S.C. 154(b) by 0 days.

(21) Appl. No.: 12/028,976

(22) Filed: Feb. 11, 2008

(65) Prior Publication Data

US 2008/0135573 A1 Jun. 12, 2008

Related U.S. Application Data

(63) Continuation-in-part of application No. 11/307,650, filed on Feb. 15, 2006, now Pat. No. 7,353,968.

(51) Int. Cl.
*B65D 85/02* (2006.01)

(52) U.S. Cl. ..... 206/303; 206/229; 206/805

(58) Field of Classification Search ..... 206/229, 206/303, 388, 69, 805, 817, 822, 499, 515; 220/789, 229, 780, 713, 62.18; 221/33, 45, 221/56, 58, 59, 303, 307, 309, 1; 53/436, 53/467

See application file for complete search history.

(56) References Cited

U.S. PATENT DOCUMENTS 2,601,767 A 7/1952 Wall
2,906,398 A 9/1959 Springer
3,150,808 A 9/1964 Vensel
3,330,404 A 7/1967 Brittell
4,938,375 A 7/1990 Fantacone
5,037,000 A 8/1991 Selame
5,088,620 A 2/1992 Kelliher et al.
D379,105 S 5/1997 Wilk
5,909,809 A 6/1999 Franklin
5,971,202 A 10/1999 Filbrun
6,158,614 A * 12/2000 Haines et al. ..... 221/63
7,353,968 B2 * 4/2008 Cotsalas ..... 221/1

* cited by examiner

*Primary Examiner*—J. Gregory Pickett
(74) *Attorney, Agent, or Firm*—Quick Patents, Inc.; Kevin Prince

(57) ABSTRACT

A dispenser for dispensing rubber bands is disclosed, the dispenser comprising a lower container and an upper container. The lower container is open at a top end thereof and comprises at least one side wall and one bottom wall. The bottom wall has an upward facing inner surface. The upper container is likewise open at a top end thereof, and comprises at least one side wall and one bottom wall. The bottom wall includes an aperture therein and a downward-facing outer surface. The lower container encompasses a larger volume than the upper container, the difference between the volume of the two containers being essentially the storage volume for rubber bands.

11 Claims, 3 Drawing Sheets

POP-UP RUBBER BAND DISPENSER

CROSS-REFERENCE TO RELATED APPLICATIONS

The application is a continuation-in-part of U.S. patent application Ser. No. 11/307,650, filed on Feb. 15, 2006.

STATEMENT REGARDING FEDERALLY SPONSORED RESEARCH AND DEVELOPMENT

Not Applicable.

FIELD OF THE INVENTION

This invention relates to office products and, more specifically, to an improved rubber band dispenser.

DISCUSSION OF RELATED ART

Consumable office products, such as paper clips and rubber bands, tend to collect in drawers or desktop trays in a somewhat unorganized manner. To keep such items organized, it is well known to contain such products in a container of some fashion.

Rubber bands, however, due to their elasticity, are sometimes difficult to manage. Pulling one rubber band out of a container, such as a simple tray, for example, often results in several other rubber bands spilling out over the side. Further, if the tray is inadvertently tipped or inverted, rubber bands can spill out of the tray easily.

The proverbial rubber band ball, an example of which is illustrated in U.S. Design Pat. No. 379,105 to Wilk on May 6, 1997, is often used to organize and store rubber bands. While such a device has the advantage that tipping it over will not result in a massive spill of rubber bands, such rubber band balls do have several drawbacks, one of which is that they are difficult to use with one hand, such as is often desired, particularly if one's other hand is holding a phone or the like. Another drawback is that at a certain point, when the rubber bands are depleted in such a rubber band ball, the rubber bands will just fall apart in a heap and will need to be stored in a container or bag of some sort anyway. Yet another drawback is that you can only pick-out the top-most rubber band. In the case where the user is desiring a rubber band of a particular color or size, it may be trapped by undesired outermost rubber bands.

An elastic band holder, disclosed in U.S. Pat. No. 5,909,809 to Franklin on Jun. 8, 1999, is a device that holds rubber bands in a slightly expanded fashion around the holder. While the last few rubber bands being held by such a device will not fall off in a heap, such as in a rubber band ball, this type of device also requires two-handed operation. Further, such a device needs to be carefully loaded with rubber bands before use, which is time consuming and inconvenient.

U.S. Pat. No. 5,037,000 to Selame on Aug. 6, 1991 discloses a rubber band dispenser that allows the device to be loaded easily just by inverting the device in its open position and pouring rubber bands into a receptacle cover. The device is then closed, and rubber bands are pulled successively from an aperture in the top of the device. While such a device is more effective than the previously mentioned prior art solutions, this type of device has several drawbacks as well. Principally, when fully loaded, rubber bands often are pulled out together due to friction between rubber bands. The rubber bands that are pulled out in addition to the one rubber band that was desired end-up spilling out of the container and onto the desk or table upon which such a device sits. Further, such a device makes no provision for securing the device to the table or desk, which results in the device being lifted from the desk when attempting to pull a rubber band from the device and the device is fairly full of rubber bands. In such a situation, the user must use two hands to manually pull the rubber band from the container. Further, the footprint of such a device is fairly large compared to its height, and thus it takes up a fair amount of space on the desktop for the number of rubber bands it can hold.

In my previous patent application, of which this application is a continuation-in-part, I disclosed a device that overcomes much of the aforementioned drawbacks. However, since the filing of the -650 application, I have discovered more about the relationship of the size of the rubber bands and the characteristics of the containers therefore that allow improved performance and ease-of-use.

Clearly, then, there is a need for a rubber band dispenser that provides more reliable one-handed access to rubber bands contained therein. Such a needed device would be able to hold a large number of rubber bands in a fairly small desktop footprint. Such a needed device would allow for the user to select a particular color or size of rubber band, if desired. Further, such a needed device would more reliably urge subsequent rubber bands to "pop-up" ready for dispensing upon pulling out a first rubber band. The needed device further would not lift up from the desk or table top when a rubber band is pulled therefrom. The present invention accomplishes these and other objectives.

SUMMARY OF THE INVENTION

The present invention is a dispenser for dispensing rubber bands. The dispenser comprises a lower container and an upper container. The lower container is open at a top end thereof and comprises at least one side wall and one bottom wall. The bottom wall has an upward facing inner surface. The upper container is likewise open at a top end thereof, and comprises at least one side wall and one bottom wall. The bottom wall includes an aperture therein and a downward-facing outer surface.

The lower container encompasses a larger volume than the upper container, the difference between the volume of the two containers being essentially the storage volume for rubber bands. Further, each container has a generally upward-facing concave shape in a vertical cross-section. In one embodiment of the invention, a hopper space is provided between the upper container and the lower container, whereby rubber bands are contained within the hopper space where they gradually fall into the space between the lower wall of the upper container and the lower wall of the lower container and are further compressed by neighboring rubber bands as rubber bands are dispensed over time.

In use, the lower container is filled with rubber bands. The upper container is then pressed down such that the upper container nests within the lower container, thereby compressing the plurality of rubber bands between the outer surface of the upper container and the inner surface of the lower container.

To obtain a rubber band, a user reaches into the upper container and grasps part of a rubber band that is either partially projecting through the aperture or is accessible through the aperture. Upon pulling the one rubber band from the dispenser, due to the compression of the rubber bands and the resulting increased friction between each rubber band, the one rubber band pulls other rubber bands at least partially through the aperture. This results in a plurality of rubber bands extending at least partially through the aperture, whereby such rubber bands may be easily selected and grasped when subsequently desired. Several rubber bands may, in fact, be caused to completely traverse the aperture, as illustrated in FIGS. 6 and 7. Such rubber bands are thereby held in the upper container where they may be, in turn, easily selected and grasped when another rubber band, perhaps of a particular size or color, is desired.

A locking means is included in the upper container, and a cooperating locking means is included in the lower container, such that the upper and lower containers may be selectively locked together in a nested configuration.

The present invention is a rubber band dispenser that provides easy one-handed access to rubber bands contained therein. The present invention can be configured to hold a large number of rubber bands in a fairly small desktop footprint. Further, the present device urges subsequent rubber bands to "pop-up" ready for dispensing upon pulling out a first rubber band. The present invention can be easily adapted to not lift up from the desk or table top when a rubber band is pulled therefrom, and can be made relatively inexpensively and efficiently by injection molding techniques. Further, the present invention is easy to refill quickly with rubber bands, and allows for the user to select a particular color or size of rubber band, if desired. The present device if flexible in that it can be manufactured as a permanent refillable device, or marketed as a disposable device pre-filled with rubber bands. Other features and advantages of the present invention will become apparent from the following more detailed description, taken in conjunction with the accompanying drawings, which illustrate, by way of example, the principles of the invention.

DETAILED DESCRIPTION OF THE PREFERRED EMBODIMENT

Figure 1:
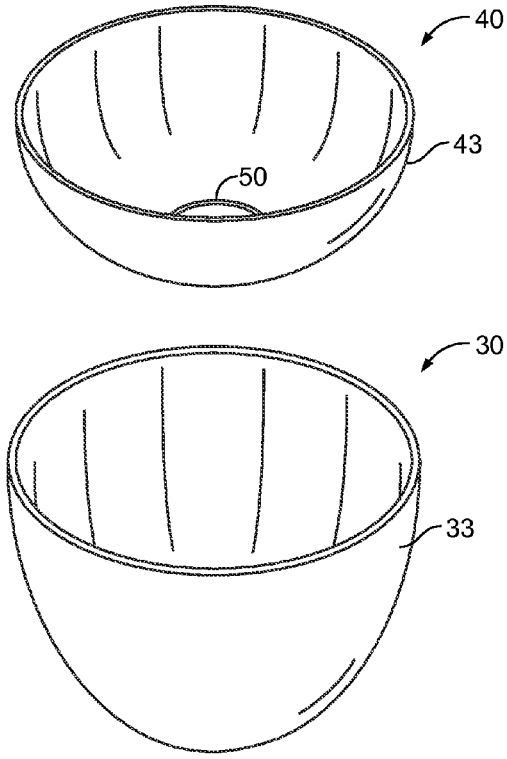
FIG. 1 is an exploded perspective view of the invention, illustrating a lower container and an upper container thereof.
Figure 2:
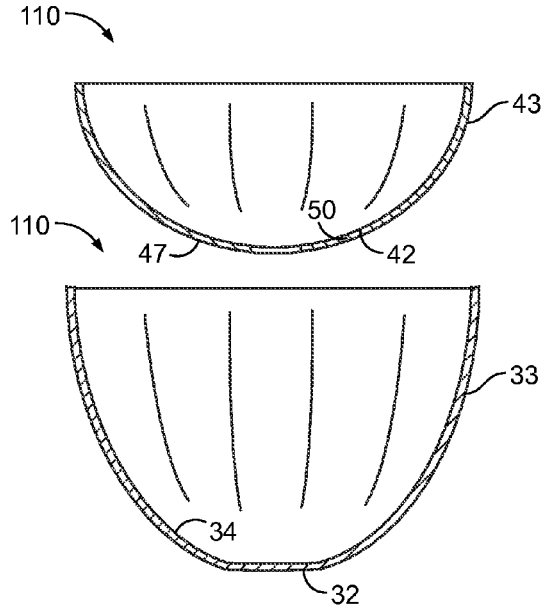
FIG. 2 is an exploded cross-sectional view of the invention.
Figure 4:
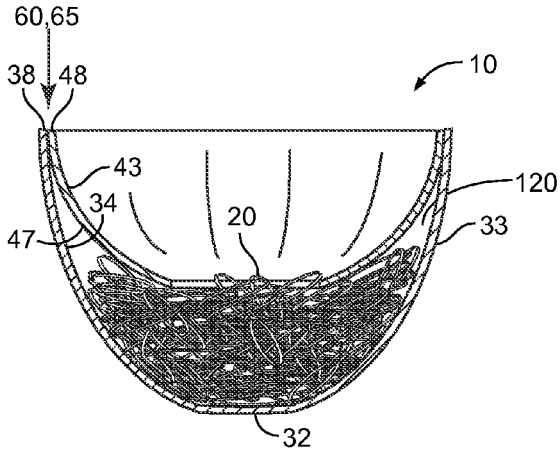
FIG. 4 is a cross-sectional view of the invention, illustrating the plurality of rubber bands compressed between the upper and lower containers.
Figure 3:
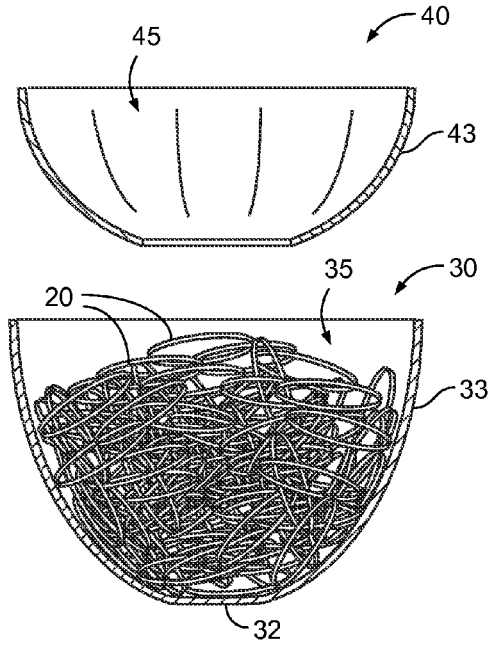
FIG. 3 is an exploded cross-sectional view of the invention, illustrating a plurality of rubber bands as held in the lower container.

FIGS. 1 & 4 illustrate a dispenser 10 for dispensing rubber bands 20. The dispenser 10 comprises, in its most general form, a lower container 30 and an upper container 40. The lower container 30 is open at a top end 35 thereof and comprises at least one side wall 33 and one bottom wall 32 (FIGS. 1-3). The bottom wall 32 has an upward facing inner surface 34.

The upper container 40 is likewise open at a top end 45 thereof, and comprises at least one side wall 43 and one bottom wall 42. The bottom wall 42 includes an aperture 50 therein (FIGS. 1 and 2) and a downward-facing outer surface 47 (FIG. 2).

Each container 30,40 is preferably made from an at least semi-rigid plastic material, but can also be fashioned from metal, wood, or any other suitably rigid or semi-rigid material. Further, each container 30,40 may be made from a translucent or transparent material, whereby the amount of rubber bands 20 contained therein may be easily observed. Each container 30,40 may have a round cross-section in a horizontal plane, as is the case with the embodiment of the invention illustrated in FIGS. 1-8. Alternately, the containers 30,40 may have a square or rectangular cross-section in the horizontal plane, as is the case with the embodiments shown in FIGS. 9-12. Clearly, any suitable shape for the containers 30,40 may be used, such as oval, hexagonal, octagonal, or the like, provided that the containers 30,40 are nestable. Further, the upper container 40 may take a different general shape than the upper container 30, provided that the containers 30,40 cooperate at their respective rims 38,48 (FIG. 4) to allow nesting of the upper container 40 into the lower container 30.

The lower container 30 encompasses a larger volume than the upper container 40, the difference between the volume of the two containers 30,40 being essentially the dispenser volume for retaining the rubber bands 20. Preferably the dispenser volume is between 30% and 70% of the uncompressed volume of the plurality of rubber bands, and optimally close to 50%. Further, the upper container 30 has a generally upward-facing concave shape in a vertical cross-section (FIG. 2). In one embodiment of the invention, a hopper space 120 is provided between the upper container 40 and the lower container 30 (FIG. 4), whereby rubber bands 20 are contained within the hopper space 120 where they gradually fall into the space between the lower wall 42 of the upper container 40 and the lower wall 32 of the lower container 30. As rubber bands 20 are pulled from the dispenser 10, the rubber bands 20 falling from the hopper space 120 become further compressed between the containers 30,40 as they are, over time, urged towards the aperture 50. As such, the rubber bands 20 in the hopper space 120 tend to be amongst the last rubber bands 20 dispensed from the dispenser 10, and such a dispenser 10 can hold a far greater number of rubber bands 20 than a simple container, or the like.

The lower container 30 can include a weighted base (not shown) so that the force exerted to free a rubber band 20 from the dispenser 10 does not lift the dispenser 10 off of a table, desk, or the like. Alternately, two-sided adhesive tape or hook-and-loop type fastener can be used to secure the container 30 to a desk or table (not shown).

In use, the lower container 30 is filled with rubber bands 20 (FIG. 3). The upper container 40 is then pressed down such that the upper container 40 nests within the lower container 30, thereby compressing the plurality of rubber bands 20 between the outer surface 47 of the upper container 30 and the inner surface 34 of the lower container 30 (FIG. 4). Preferably the plurality of rubber bands 20 is compressed to about half of its original volume (FIGS. 3 & 4).

Figure 5:
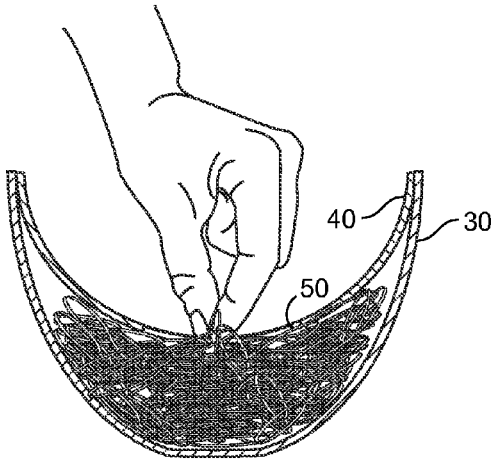
FIG. 5 is a cross-sectional view of the invention, illustrating a person's hand grasping one of the rubber bands for extraction from the invention.
Figure 6:
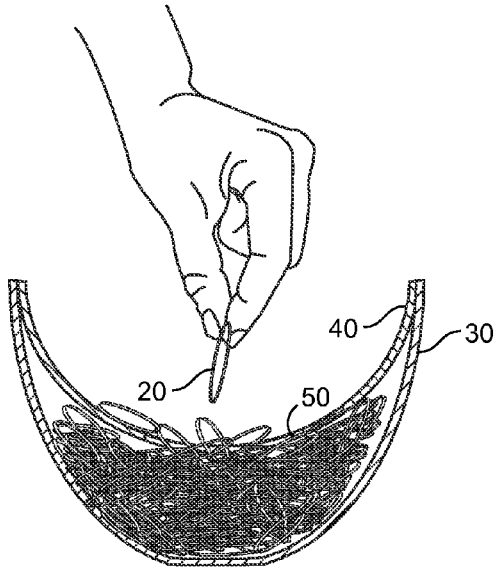
FIG. 6 is a cross-sectional view of the invention, illustrating a number of rubber bands that have been pulled at least partially out of an aperture of the upper container as a result of the one rubber band being extracted.
Figure 7:
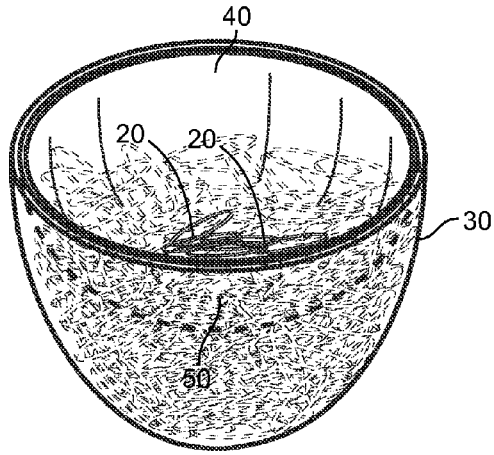
FIG. 7 is a perspective view of the invention, illustrating a number of rubber bands laying in the upper container after having been at least partially pulled out of the aperture of the upper container.

To obtain a rubber band 20, a user reaches into the upper container 40 and grasps part of a rubber band 20 that is either partially projecting through the aperture 50 or is accessible through the aperture 50 (FIG. 5). Upon pulling the one rubber band 20 from the dispenser 10, due to the compression of the rubber bands 20 and the resulting increased friction between each rubber band 20, the one rubber band 20 pulls other rubber bands 20 at least partially through the aperture 50 (FIG. 6). This results in a plurality of rubber bands 20 extending at least partially through the aperture 50, whereby such rubber bands 20 may be easily selected and grasped when subsequently desired. Several rubber bands may, in fact, be caused to completely traverse the aperture 50, as illustrated in FIGS. 6 and 7. Such rubber bands 20 are thereby held in the upper container 40 where they may be easily selected and grasped when another rubber band 20 is desired. Herein I shall use the term "pop-up rate" to define the percentage of times that when pulling one rubber band 20 from the dispenser 10 at least one other rubber band 20 is pulled at least partially through the aperture 50.

As the rubber bands 20 are depleted from the lower container 30 over time, the compression of the rubber bands 20 is incrementally decreased, and the effect of one rubber band 20 pulling other rubber bands 20 towards the aperture 50 is decreased. At some point, when the rubber bands 20 are no longer under sufficient compression to pull each other toward the aperture 50 through friction, either the lower container 30 may be refilled with additional rubber bands 20 or the entire supply may be depleted as with conventional rubber band containers.

Figure 8:
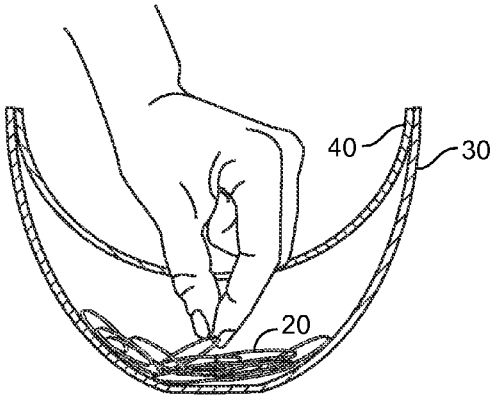
FIG. 8 is a cross-sectional view of the invention, illustrating a person reaching in to grasp one of the rubber bands after most of the rubber bands have been dispensed from the invention.

The last few rubber bands 20 may be grasped by extending one's fingers through the aperture 50, as illustrated in FIG. 8, in embodiments having a sufficiently large aperture 50. The aperture 50 is preferably of such a shape and size as to allow at least a users thumb and forefinger to extend therethough and grasp a rubber band laying on the bottom wall 32 of the lower container 30 (FIG. 8). However, the aperture 50 should not be so large that it reduces the effective surface area of the downward-facing outer surface 47 of the upper container 40 (FIG. 4). Such an oversized aperture 50, it has been found, reduces the compression between the outer surface 47 of the upper container 40 and the inner surface 34 of the lower container 30 to the point where the rubber bands 20 cannot effectively pull each other towards the aperture 50 during extraction. Clearly the aperture diameter can only be as large as permitted by the diameter of the container 40, but preferably the aperture diameter is never larger than 80% of the diameter of the upper container 40.

An aperture size of roughly the average diameter of the rubber bands 20 has been found to be optimal. With an aperture size smaller than about 70% of the average rubber band diameter, not only is it difficult to remove the first rubber band 20 and the last rubber band 20, but not many of the other rubber bands 20 become partially extracted through the aperture 50 due to the small aperture size. With an aperture size of larger than about 150% of the diameter of the rubber bands 20, compression of the rubber bands 20 is reduced to the point where, again, not many rubber bands 20 are pulled partially through the aperture 50 for convenient subsequent dispensing. Thus, at least with #32 rubber bands having approximately a 2 inch diameter (when formed roughly into a circle), an aperture diameter of about 2 inches is optimal. Clearly a mix of different rubber band sizes may be used with the dispenser 10, in which case it has been discovered that the aperture 50 size is optimally about the average rubber band 20 diameter to result in the desired "pop-up" action heretofore described.

Specifically, it has been found that for #16 rubber bands 20, each having an approximate diameter of 1.6", the aperture 50 of the upper container 40 is optimally 1.6", but in no case outside of the range of 1.12" and 2.40". For #19, #33, #64, and #84 rubber bands 20, each having an approximate diameter of 2.2", the aperture 50 of the upper container 40 is optimally 2.2", but in no case outside of the range of 1.54" and 3.30". For #32 rubber bands 20, each having an approximate diameter of 1.9", the aperture 50 of the upper container 40 is optimally 1.9", but in no case outside of the range of 1.33" and 2.85". Optimal aperture size results typically in a "pop-up" rate of higher than 80%, that is, upon removing one rubber band 20 other rubber bands 20 are at least partially also pulled through the aperture 50. Rubber bands 20 that are relatively thin, such as #16 rubber band 20 that are 1/16" wide as compared to 1/8" wide #33 rubber bands, have a slightly reduced "pop-up" rate due to their lower volume when compressed, and hence their lower compression force.

When mixing different sizes of rubber bands 20, it has been found that the optimal aperture 50 diameter is the weighted average diameter of the rubber bands 20. In one experiment I conducted, I mixed #33 and #16 rubber bands having 2.2" and 1.6" diameters, respectively. With an aperture diameter of 2.2", a mix of 100% #33 rubber bands 20 resulted in the highest pop-up rate of 88%. A mixture of 80% #33 rubber bands 20 and 20% #16 rubber bands 20 resulted in a pop-up rate of only 60%. A 60%/40% mixture of #33 and #16 rubber bands 20, respectively, resulted in only a 49% successful pop-up rate.

Similarly, mixing equal amounts of three sizes of rubber bands 20, specifically #16, #32, and #33 sized rubber bands 20 having respective diameters of 1.6", 1.9", and 2.2", it was found that an aperture diameter of 1.9" was optimal, resulting in an 80% successful pop-up rate. When the aperture diameter was changed to 2.2", the pop-up rate was reduced to 60%. Thus, the aperture diameter with a mixture of rubber bands 20 is preferably as close to the weighted average diameter of the rubber bands 20 to be used. Thus it has been found that the larger the difference between the aperture diameter and the weighted average of the rubber bands 20, the lower the pop-up rate experienced.

The aperture 50 preferably is shaped as either circular, oval, rounded rectangular, or other shapes provide they have no sharp corners and have substantially the same area as the average area of the rubber bands 20 when the rubber bands 20 are in a circular configuration. The sides of the aperture 50 are preferably smooth, presenting no sharp edges that could cut or facilitate tearing of the rubber bands 20.

A locking means 60 is included in the upper container 40, and a cooperating locking means 65 is included in the lower container, such that the upper and lower containers 40,30 may be selectively locked together in a nested configuration. In one embodiment of the invention, the locking means 60 and cooperating locking means 65 is simply friction between the two containers 30,40 (FIG. 4). Friction between the rim 38 of the lower container and the rim 48 of the upper container 40 holds the upper container 40 within the lower container 30. In such an embodiment, the friction between each container 30,40 is designed to be sufficient to hold the container 30,40 together even against an expansion force of the compressed rubber bands 20 urging the containers 30,40 apart and the force caused by pulling rubber bands 20 out of the aperture 50 (FIGS. 2 & 4).

Figure 11:
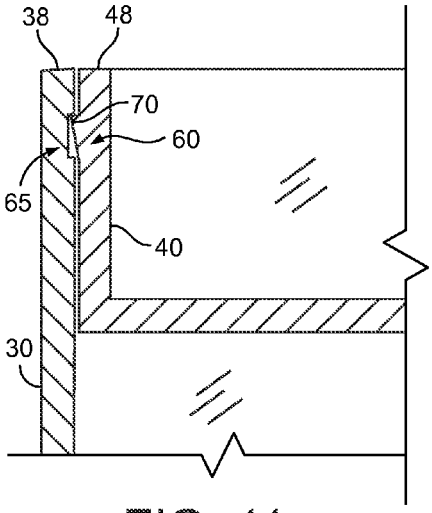
FIG. 11 is a partial cross-sectional view of the invention, taken generally along lines 11-11 of FIG. 9, illustrating a mechanical locking means of one embodiment of the invention.

In another embodiment of the invention, illustrated in FIG. 11, the locking means and cooperating locking means 60,65 is a selectively engageable locking means 70, such as a lip and groove 60,65. The selectively engageable mechanical locking means 70 locks the rim 48 of the upper container 40 to the rim 38 of the lower container 30. In such an embodiment, a user may grasp the upper container 40 through the aperture 50 thereof while, with another hand, grasping the lower container 30 to apply a pulling force sufficient to temporarily deform the mechanical locking means 70 and pull the upper container 40 out of the lower container 30.

Figure 12:
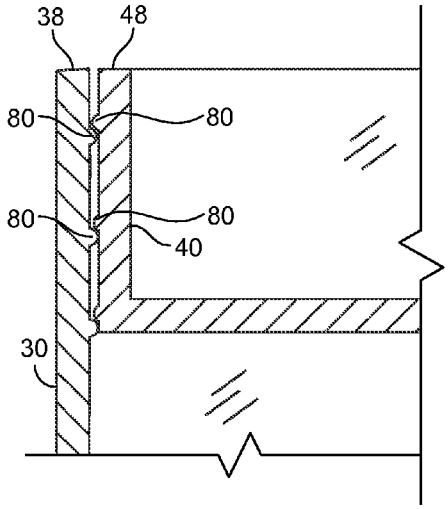
FIG. 12 is a partial cross-sectional view of the invention, taken generally along lines 11-11 of FIG. 9, illustrating a cooperating thread locking means of one embodiment of the invention.

In yet another embodiment of the invention, illustrated in FIG. 12, the locking means 60 and cooperative locking means 65 is a pair of cooperating threads 80. In such an embodiment, the lower container 30 and the upper container are rotated with respect to each other in one direction to lock the containers 30,40 in their nested configuration, or in the opposite direction to free the containers 30,40 from each other.

Clearly other locking means 60 and cooperating locking means 65 may be used without departing from the spirit and scope of the invention, which in its essence is that the two containers 30,40 may be selectively locked together by some suitable means in the nested configuration illustrated in FIG. 4.

Figure 9:
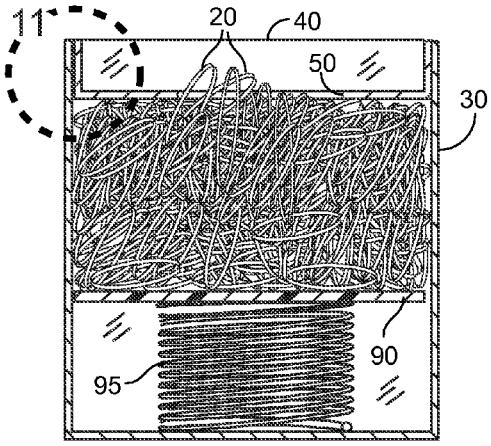
FIG. 9 is a cross-sectional view of an alternate embodiment of the invention having a rectangular-shaped upper and lower container, further illustrating a spring-biased friction plate, the spring in a substantially compressed state.
Figure 10:
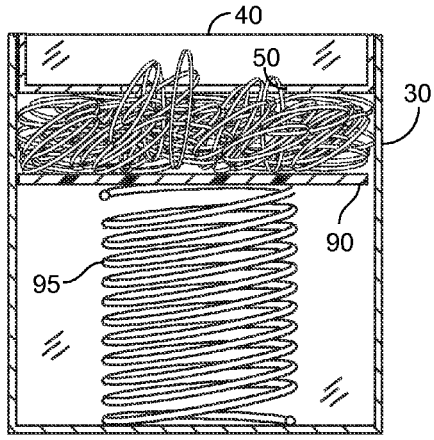
FIG. 10 is a cross-sectional view of the alternate embodiment of the invention, illustrating the spring in a substantially decompressed state.

In an alternate embodiment of the invention, illustrated in FIGS. 9-10, the lower container 30 further includes a friction plate 90 attached to the inner surface 34 thereof. Preferably the friction plate has the same cross-sectional shape in the horizontal plane as does the lower container 30, and the size of the cross-sectional shape is consistent along the vertical length of the lower container 30. As such, the friction plate 90 may slide up and down the lower container 30 while keeping the same distance from either side of the inner surface 34 of the side wall 33 (FIG. 2). Further, a biasing means 95, such as a spring, is fixed between the lower wall 32 of the lower container and the friction plate 90.

As such, rubber bands 20 contained between the upper container 40 and the friction plate 90 are continuously urged upward toward the upper container 30, and are kept at essentially a constant compression, both when full of rubber band 20 as illustrated in FIG. 9, and when nearly depleted of rubber bands 20 as illustrated in FIG. 10. The spring 95 is preferably such that it compresses the rubber bands 20 to about half of their normal volume. It has been found that any more pressure causes the rubber bands 20 to exert more friction on their neighboring rubber bands 20 to the point where large clumps of rubber bands 20 come completely out of the aperture 50. If much less pressure is exerted then the rubber bands 20 fail to adequately pull their neighboring rubber bands 20 towards the aperture, reducing the pop-up rate.

While a particular form of the invention has been illustrated and described, it will be apparent that various modifications can be made without departing from the spirit and scope of the invention. For example, the size and shape of the containers 30,40, as well as the size and shape of the aperture 50 in the upper container 40, may be modified extensively. Further, the materials used for the upper and lower containers 40,30 may be modified extensively. Still further, other items than rubber band 20 may be dispensed by the dispenser 10, such as elastic hair bands, paper clips, or other small items. Accordingly, it is not intended that the invention be limited, except as by the appended claims.

What is claimed is:

1. A dispenser for dispensing rubber bands, comprising:

a lower container open at a top end thereof, the lower container comprising at least one side wall and one bottom wall, the lower container having an upward-facing, substantially concave and curved inner surface; and a plurality of rubber bands having a weighted average diameter and an uncompressed volume;

an upper container open at a top end thereof, the upper container comprising at least one side wall and one bottom wall, the bottom wall including an aperture therein, the upper container including a substantially convex and curved downward-facing outer surface, the upper container nestable into the lower container to define a dispenser volume therebetween, the dispenser volume being between 30% and 70% of the uncompressed volume of the plurality of rubber bands, the diameter of the aperture being between 70% and 150% the average diameter of the rubber bands;

whereby with the plurality of rubber bands contained in the lower container, the upper container may be nested into the lower container and frictionally held thereby to compress the rubber bands into the dispenser volume, the rubber bands thereby being available for dispensing through the aperture of the upper container.

2. The dispenser of claim 1 wherein the upper container includes a locking means and the lower container includes a cooperating locking means, whereby the upper and lower containers may be selectively locked together by their respective locking means.

3. The dispenser of claim 2 wherein each locking means of each container is a friction fit between each container when nested, such a friction fit overcoming any expansion forces applied between the containers by the rubber bands.

4. The dispenser of claim 2 wherein locking means of the lower container is a selectively engageable mechanical locking means for locking a rim of the upper container with respect to a rim of the lower container.

5. The dispenser of claim 2 wherein locking means of each container is a cooperating thread proximate the rim of each container, whereby the containers may be twisted with respect to each other to engage or disengage their cooperating threads.

6. The dispenser of claim 1 wherein the cross-sectional shape of each container in a horizontal plane is substantially circular.

7. The dispenser of claim 1 wherein the cross-sectional shape of each container in a horizontal plane is substantially oval.

8. The dispenser of claim 1 wherein the lower container further includes a weighted base for holding the dispenser down by gravity when a rubber band is being pulled from the dispenser.

9. The dispenser of claim 1 wherein the rubber bands are size #16 having an average diameter of approximately 1.6", and wherein the aperture in the upper container has a diameter of between 1.12" and 2.40".

10. The dispenser of claim 1 wherein the rubber bands are size #19, #33, #64 or #84, each having an average diameter of approximately 2.2", and wherein the aperture in the upper container has a diameter of between 1.54" and 3.30".

11. The dispenser of claim 1 wherein the rubber bands are size #32 having an average diameter of approximately 1.9", and wherein the aperture in the upper container has a diameter of between 1.33" and 2.85".

* * * * *